United States Patent [19]

Krulwich

[11] 4,221,164

[45] Sep. 9, 1980

[54] MAGNETIC STAMP PAD APPLICATOR

[76] Inventor: Lester S. Krulwich, 241 Central Park West, New York, N.Y. 10024

[21] Appl. No.: 937,796

[22] Filed: Aug. 29, 1978

[51] Int. Cl.[3] ..... B41J 1/60

[52] U.S. Cl. ..... 101/109; 101/382 MV; 101/405

[58] Field of Search ..... 101/327, 333, 368, 405–406, 101/109, 112, 103, 84, 29, 382 MV

[56] References Cited

U.S. PATENT DOCUMENTS

| | | | |
|---|---|---|---|
| 457,304 | 8/1891 | Cross | 101/109 |
| 3,302,566 | 2/1967 | Blanchet | 101/405 |
| 3,351,003 | 11/1967 | McCoy | 101/29 |
| 3,629,756 | 12/1971 | Holtz | 101/382 MV |
| 4,154,166 | 5/1979 | Knott | 101/382 MV |

*Primary Examiner*—Edgar S. Burr
*Assistant Examiner*—A. Heinz

[57] ABSTRACT

A stamp pad applicator consisting of an oblong plate with a plurality of openings into which an applicator handle may be inserted. Removably attached under the plate are a plurality of sections together matching the oblong plate. Midway in each section an opening is aligned with the oblong plate openings. A magnet is attached to the bottom of the applicator handle. A magnetically attractable flat plate is fastened to the outside of each section and removably attachable on the flat plates are portions of flexible magnetic rubber tape capable of being cut into various shapes by scissors or knife. The magnet on the handle, by insertion in an oblong and section opening, magnetically engages the back of a flat plate and pushes that section partially out for stamping. Another magnet is optionally fastened in each section opening against each flat plate with this magnet and the magnet on the handle having the same magnetic pole facing each other thereby repelling the section forward when the handle is inserted.

1 Claim, 5 Drawing Figures

MAGNETIC STAMP PAD APPLICATOR

This invention relates to a magnetic stamp pad applicator with which a number of rubber stampers are removably attachable magnetically on the same applicator. Besides the time wasted looking for a particular stamp pad applicator and discarding so many old ones it will be of considerable personal and business value if, as with this invention, a variety of marks and designs can be cut out in a few moments and tried on a stamp pad.

An important object of this invention is to provide a hand applicator for a stamp pad enabling the user to create his own stamping material readily and to stamp many of them on a pad with the same applicator.

Another object of this invention is to provide an applicator for a stamp pad on which different stamping material may remain, be substituted or used agian.

Another object of this invention is to provide an applicator for a stamp pad capable of removably holding a variety of rubber stampings making it less likely that any will be mislaid.

Another object of this invention is to provide an applicator for a stamp pad that is more efficient than those currently available and relatively inexpensive to make.

Further objects and structural details of the invention will be apparent from the following description when read in conjunction with accompanying drawings forming a part of this specification, wherein.

Figure 1:
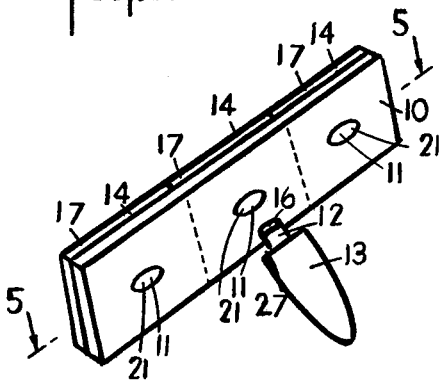
FIG. 1 is a perspective view of an embodiment of my invention before the handle is inserted and without the holding strip around the edges. Some parts are shown in other illustrations.
Figure 2:
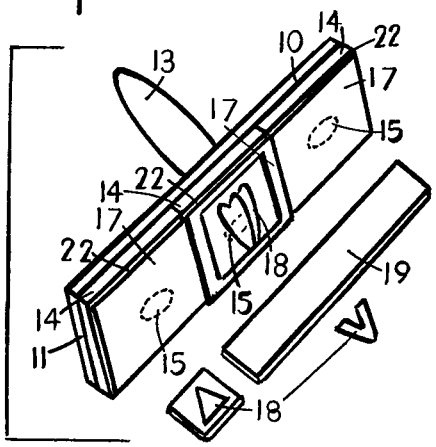
FIG. 2 is a perspective view showing the sections after the handle is inserted in one of them. It also shows the magnetic rubber tape with part cut out, part stencil cut and a mark fastened on a part adhering to a flat plate.
Figure 5:
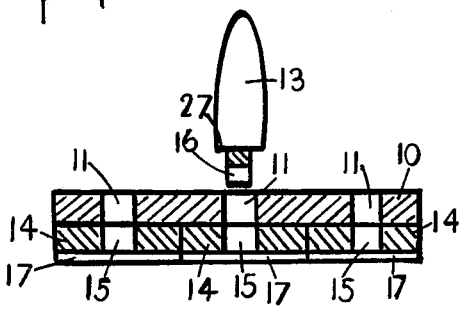
FIG. 5 is a section on line 5—5 of FIG. 1.
Figure 3:
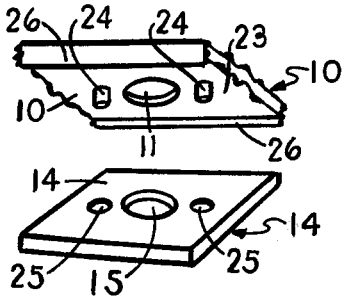
FIG. 3 is a partially elevated view of part of the back of the oblong plate revealing the holding strip on the edge and the small magnets. The other view is the back of the aligned section with the small openings to accommodate the small magnets.
Figure 4:
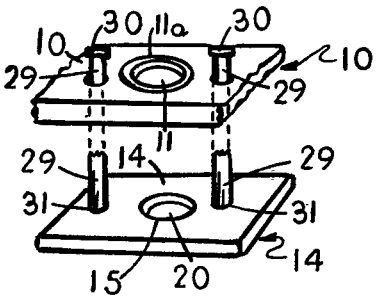
FIG. 4 is a partially elevated view of an outside part of the oblong plate showing the thin posts and their heads. The other partial view is the back of a section showing the posts attached and the repelling magnet in the opening against the back of the flat plate.

Upon reference to the drawings in detail, they show a stamp pad applicator consisting of an oblong plate 10 with a plurality of openings 11 into which the bottom 12 of an applicator handle 13 may be inserted. Removably attached under the oblong plate 10 are a plurality of sections 14 together approximately matching the dimensions of the oblong plate 10. An opening 15 is in the middle of each section 14, aligned with the openings 11 in the oblong plate 10 and capable of accommodating the bottom 12 of the applicator handle 13 to which a magnet 16 is attached. Fastened on the outside surface of each section 14 is a magnetically attractable flat plate 17, each covering the section 14 and its opening 15. Removably attachable on the flat plates 17 are portions 18 of a flexible magnetic rubber 19 which is capable of being cut into various shapes by scissors or a knife. The magnet 16 on the handle 13, by insertion through any of the oblong plate openings 11 and into its aligned section opening 15 is capable of magnetically engaging the back of the flat plate 17 and pushing that section 14 partially out and on the stamp pad. Another magnet 20 is optionally fastened in the opening 15 of each section 14 against its flat 17 with magnetic pole the same as the magnetic pole on the opposite side of the magnet 16 on the handle 13 thereby repelling the section 14 outward and down on the stamp pad and paper when applied.

The stamp pad applicator device utilizes a conventional stamp pad and provides an oblong plate 10, for example of wood 6 inches long, $1\frac{3}{8}$ inches wide and $\frac{1}{4}$ inch thick, with a plurality of openings 11, such as three $\frac{1}{2}$ inch round holes midway 21 in every $\frac{1}{3}$ longitudinal part of the oblong plate 10. Removably attached under the oblong plate 10 are a plurality of similar sections 14, for example three, together of the same dimensions as the oblong plate 10 and preferably of the same material, such as wood, each section 14 provided with openings 15 similar to and aligned with the openings 11 in the oblong plate 10.

magnetically attractable flat plate 17, preferably of sheet iron, is separately fastened on the outside surface 22 of each section 14, thereby covering the section openings 15. The sections 14 are removably held to the bottom 23 of the oblong plate 10 by suitable means, such as by small magnets 24, partially set in the bottom 23 of the oblong plate 10, that extend into small openings 25 in the sections 14 so as to attract the back of the flat plate 17 magnetically. The oblong plate 10 is also preferably provided with a strip 26 along its outside edge extending party up along the outside edges of the section 14 and frictionally engaging the edges of those sections 14. The strip 26 may be of rubber or rubberized on its inner side.

The bottom 12 of the applicator handle 13 is frictionally and manually insertable into any of the openings 11 in the oblong plate 10 and into the corresponding opening 15 in each removable section 14. The handle 13 contains a magnet 16 fastened at the bottom 12 capable of being attracted towards and to the back of the magnetically attractable flat plate 17. The handle 13 has a surface 27 near its bottom portion which is larger than the openings 11, 15 and said surface 27 engages the surface of the oblong plate 10, limiting and allowing the insertable end of the handle 13 to enter the openings 11, 15 only sufficiently to press the opposing section 14 out so that the outer surface of that section 14 extends only slightly beyond the other sections 14 when it is stamped on the pad.

Another magnet 20 is optionally fastened against the back of the flat plate 17 inside the central opening 15 in each section 14. These magnets 20 are sufficiently within the openings 15 to leave space for the magnet 16 attached to the bottom 12 of the applicator handle 13 to at least partly enter those section openings 15 from the oblong plate openings 11. The opposing faces of the magnets 16, 20 on the sections 14 and the handle 13 are provided with the same magnetic pole thereby repelling each other and thrusting the section 14 forward when the applicator handle 13 is inserted. When structured this way, thin posts 29, having heads 30 extend freely through the oblong plate 10 and into the area 31 in which posts 29 are secured to sections 14 thereby limiting the outward repulsion to slightly beyond the other sections 14, the magnetic repulsion being stronger than the holding means retaining the sections 14 on the oblong plate 10. To accommodate the handle 13 the relative thickness of the oblong plate 10 and the sections 14 may be increased and a magnetically attractable washer 11*a* may be fastened around the opening 11 on the oblong plate 10.

The device is not limited to three sections 14 as illustrated but may contain two or six or more by changing the size or shape of the oblong plate 10 and the sections 14. The flexible magnetic tape may be of other material suitable for use on a stamp pad. Also other means of fastening and holding may be employed and additional handles 13 may be used.

OPERATION OF THE APPARATUS

The magnetic rubber tape 19 may be cut with a scissors or a knife into any shape or design, into letters, trademarks, insignias, emblems, stencils or other marks and may be peeled off or left on while the other sections 14 are used. The magnet 16 on the handle 13 sets evenly on the back of the magnetically attractable flat plate 17, pushing that section 14 out beyond the other sections 14 as it is pressed on the stamp pad and then on paper.

Although other material may be used, the magnetic rubber tape 19 stamps clearly and works excellently on conventional stamp pads. Not only is it difficult to mislay a stamp pad marker with this device but an out-of-date applicator does not have to be discarded and the total expense of manufacture is relatively modest. Also any of the frequently used nonmagnetic marks may be attached to a piece of the magnetic rubber tape 19 or to other magnetic material which will then adhere continuously or temporarily to any of the flat plates 17 on a section 14.

When the magnets 16, 20 optionally repel each other the downward pressure is compressed, thereby increasing the stamping strength both on the pad and the paper. The inserted magnets 20 also increase the magnetic attractability of the flat plates 17 and the thin posts 29 help stabilize the operation and structure of the attached parts.

I have described preferred embodiments of my invention but it is understood that various changes may be made in the form, details, arrangements and proportions of the various parts without departing from the scope of my invention.

What I claim is:

1. A stamp pad applicator comprising an applicator handle having a first end having a magnet fastened thereto, an oblong plate having a plurality of openings and small magnets partially affixed in and projecting above one surface, a plurality of sections removably attached to said one surface of said oblong plate, each section having an opening in the middle thereof aligned with one of said openings in said oblong plate, each said section having small openings extending therethrough to a magnetically attractable flat plate, said small openings receiving the projections of said small magnets, said sections having combined dimensions approximately matching the dimensions of said oblong plate, a first side of each section being adapted to be removably attached to said oblong plate, a second side of each section opposite said first side having said magnetically attractable flat plate retained on said second side by said small magnets and covering said second side and the opening in that section, flexible magnetic stamping material removably adhering to the surface of the magnetically attractable flat plate that is opposite to the surface which contacts said second side, said first end of the applicator handle being sized so that it may be frictionally and manually insertable into any of the aligned openings in the oblong plate and one of said sections, said applicator handle having a flange spaced from said end by a distance sufficient to permit the magnet carried by said first end to be inserted into a pair of aligned openings and magnetically engage the magnetically attractable flat plate covering that section's opening and move the engaged section relative to the remaining sections whereby with the oblong plate and the edges of the other sections being manually held said handle can be inserted in any pair of aligned openings to move the engaged section and its associated magnetically attachable flat plate slightly beyond the other sections before being stamped on an ink pad, and whereby said small magnets when inserted into said small openings magnetically retaining the fastened back of said flat plates to removably hold the sections to the oblong plate.

* * * * *